US006718572B2

(12) United States Patent
Schroeter

(10) Patent No.: US 6,718,572 B2
(45) Date of Patent: Apr. 13, 2004

(54) INVALID HOIST

(75) Inventor: Philip von Schroeter, Rodenbach (DE)

(73) Assignee: Arjo. Med. Artiebolog Limited, Gloucester (GB)

( * ) Notice: Subject to any disclaimer, the term of this patent is extended or adjusted under 35 U.S.C. 154(b) by 41 days.

(21) Appl. No.: 10/179,248

(22) Filed: Jun. 26, 2002

(65) Prior Publication Data

US 2003/0000013 A1 Jan. 2, 2003

(30) Foreign Application Priority Data

Jun. 29, 2001 (GB) ..... 0115904

(51) Int. Cl.[7] ..... A61G 7/10
(52) U.S. Cl. ..... 5/86.1; 5/81.1
(58) Field of Search ..... 5/81.1, 86.1, 89.1, 5/83.1

(56) References Cited

U.S. PATENT DOCUMENTS

| | | | | |
|---|---|---|---|---|
| 5,033,563 A | | 7/1991 | Brainerd, Jr. et al. | |
| 5,591,943 A | | 1/1997 | Cheng | |
| 5,790,995 A | * | 8/1998 | Caden et al. | 5/86.1 |
| 6,092,247 A | * | 7/2000 | Wilson | 5/86.1 |
| 6,134,725 A | * | 10/2000 | Bouhuijs | 5/86.1 |
| 6,289,534 B1 | | 9/2001 | Hakamiun et al. | |

FOREIGN PATENT DOCUMENTS

| | | |
|---|---|---|
| FR | 2 689 005 | 10/1993 |
| GB | 2 127 981 A | 4/1984 |
| GB | 2128760 | 5/1984 |
| GB | 2 323 348 A | 9/1998 |
| GB | 2 346 608 A | 8/2000 |
| JP | A 7-237899 | 9/1995 |

* cited by examiner

*Primary Examiner*—Teri Pham Luu
*Assistant Examiner*—Fredrick Conley
(74) *Attorney, Agent, or Firm*—Young & Thompson

(57) ABSTRACT

An invalid hoist includes a lifting arm, an actuator between the lifting arm and a mast, the lifting arm being pivotably connected to the upper end of the mast at a position intermediate its ends and the actuator being connected to the lifting arm on the side of the pivotable connection between the lifting arm and the mast remote from said one end of the lifting arm, and a connecting link pivotably connected between one end of the actuator and the lifting arm (or mast). The connecting link is connected between the actuator and the lifting arm (or mast) such that an auxiliary link incorporating a load cell can be additionally and removably connected between the actuator and the lifting arm (or mast) and such that any load applied to the lifting arm is transmitted entirely through the auxiliary link.

9 Claims, 3 Drawing Sheets

FIG 1
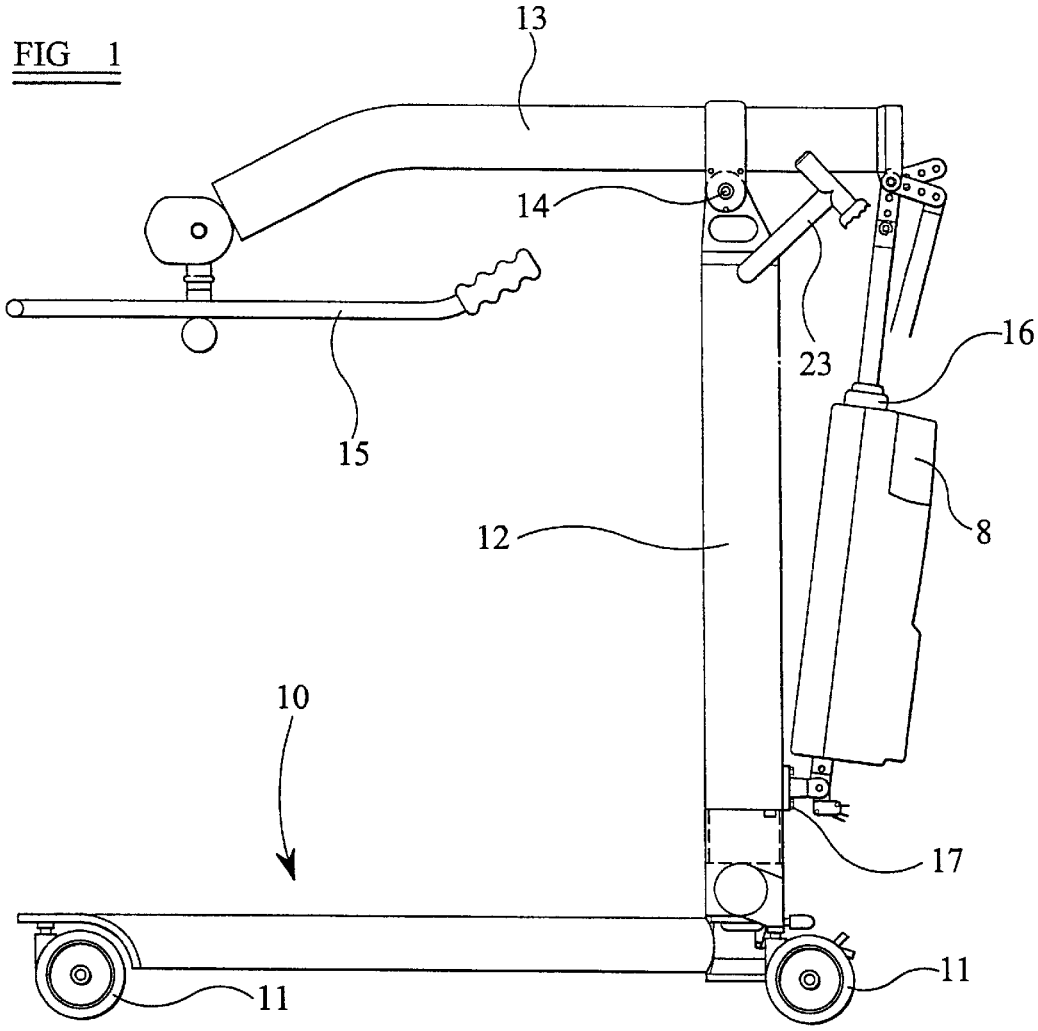
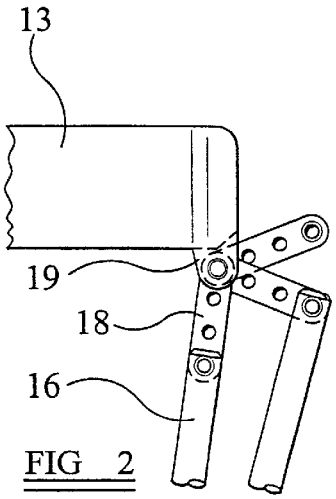
FIG 2
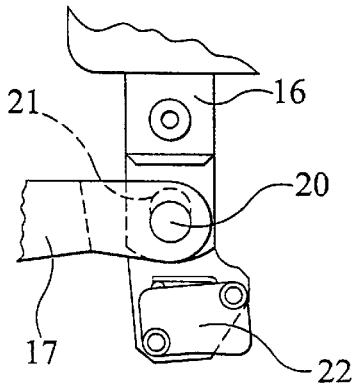
FIG 3
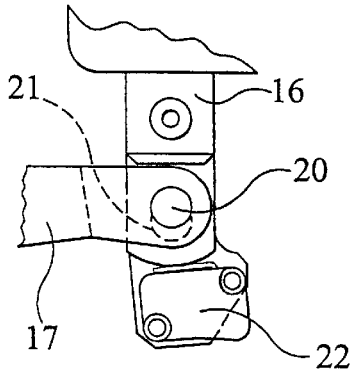
FIG 4

FIG 5
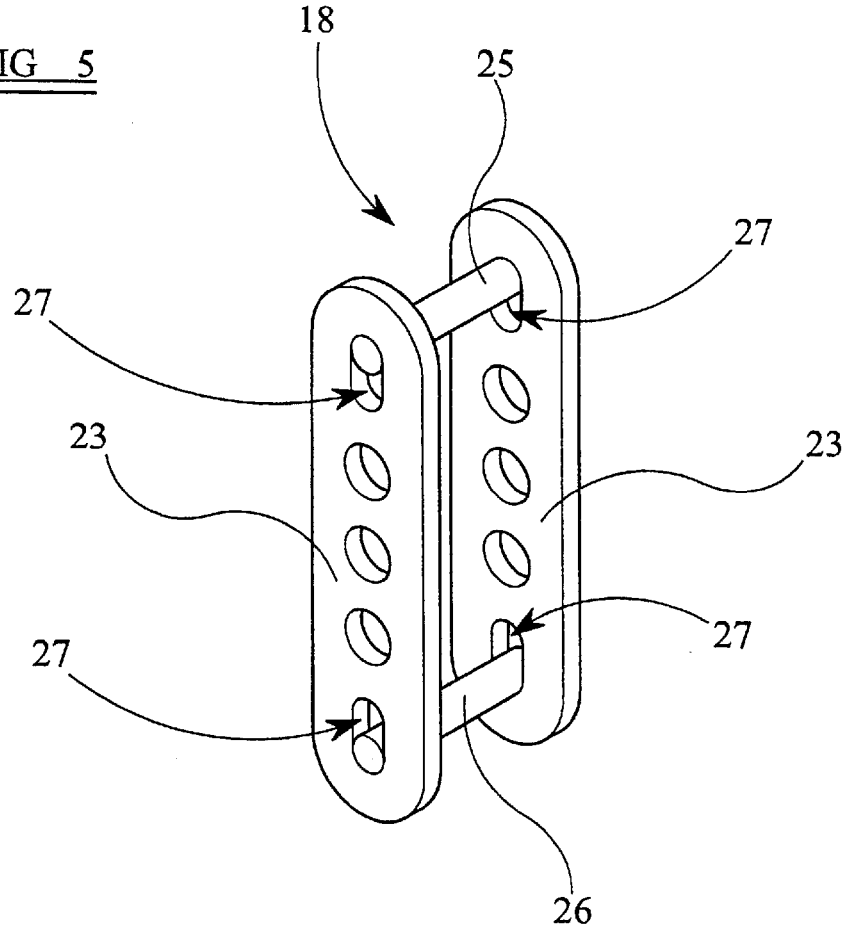
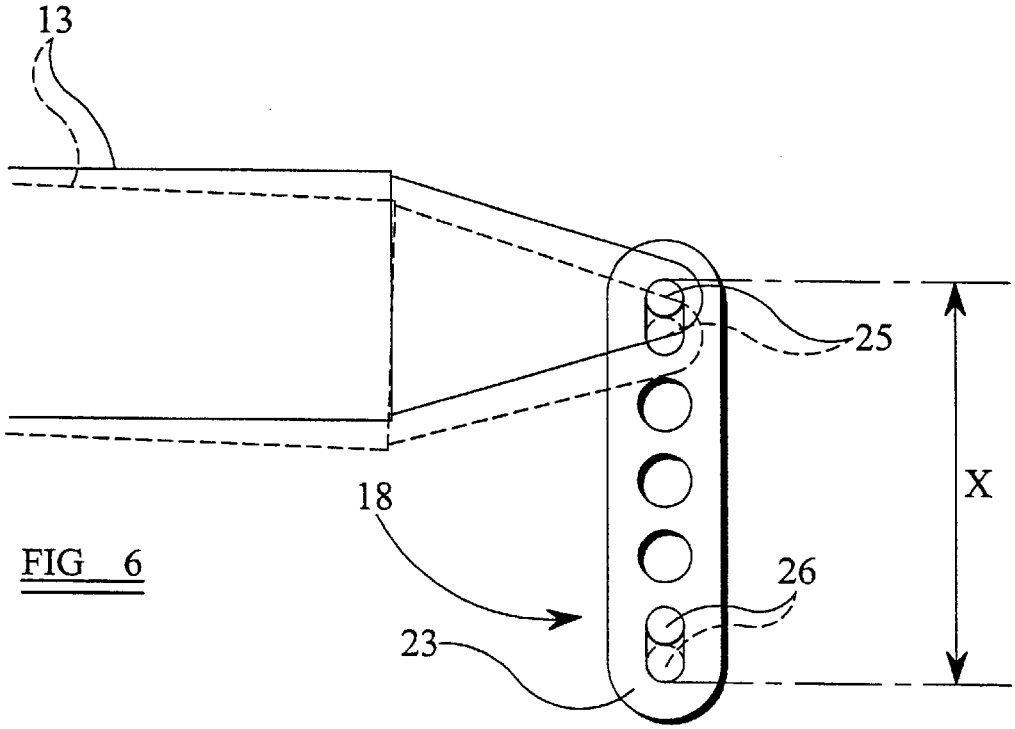
FIG 6

FIG 7
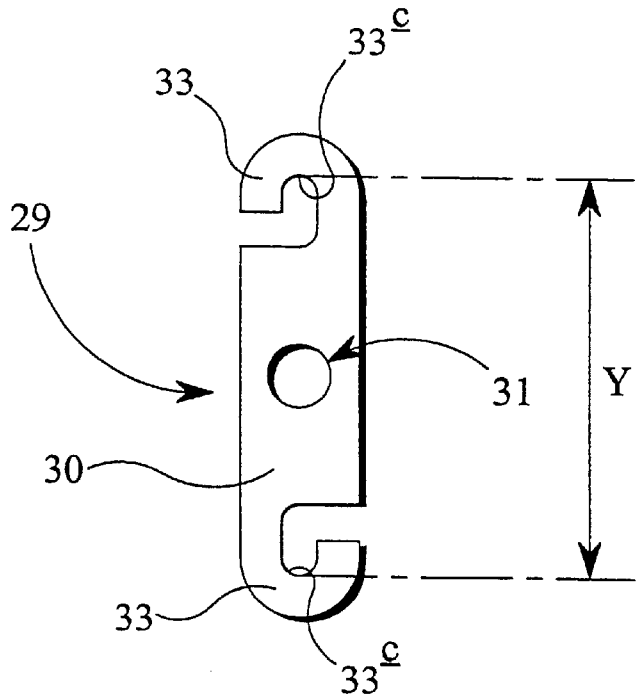
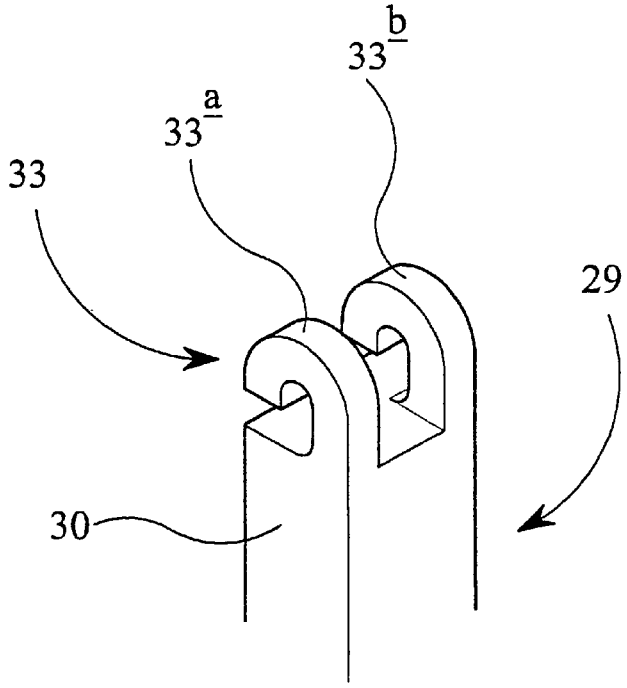
FIG 8

INVALID HOIST

This invention relates to an invalid hoist.

It is known from GB-A-2323348 to provide an invalid hoist comprising a mobile chassis, a mast upstanding from the chassis, a lifting arm pivotably connected to the upper end of the mast, the lifting arm having a sling hanger or at least one sling attachment point at or adjacent to one end thereof, a power operated extendible/retractable actuator between the lifting arm and the lower part of the mast, the lifting arm being pivotably connected to the upper end of the mast at a position intermediate its ends and the actuator being connected to the lifting arm on the side of the pivotable connection between the lifting arm and the mast remote from said one end of the lifting arm, and a link pivotably connected between one end of the actuator and either the lifting arm or the mast so that if the lifting arm meets with an obstruction during a lowering operation, the actuator and link will pivot relative to one another so that the actuator can continue to extend without applying a force to the lifting arm to urge the latter against the obstruction.

It is often a requirement to be able to weigh a patient and it is convenient to do this while the patient is supported by an invalid hoist as this saves both time and effort. However, it is expensive to provide every hoist with a load cell, for example in the lifting arm or the mast.

The present invention seeks to overcome this problem.

SUMMARY OF THE INVENTION

According to a first aspect of the present invention, there is provided an invalid hoist comprising a mobile chassis, a mast upstanding from the chassis, a lifting arm pivotably connected to the upper end of the mast, the lifting arm having a sling hanger or at least one sling attachment point at or adjacent to one end thereof, a power operated extendible/retractable actuator between the lifting arm and a lower part of the mast, the lifting arm being pivotably connected to the upper end of the mast at a position intermediate its ends and the actuator being connected to the lifting arm on the side of the pivotable connection between the lifting arm and the mast remote from said one end of the lifting arm, and a connecting link pivotably connected between one end of the actuator and the lifting arm (or the mast) so that if the lifting arm meets with an obstruction during a lowering operation, the actuator and link will pivot relative to one another so that the actuator can continue to extend without applying a force to the lifting arm to urge the latter against the obstruction, wherein the connecting link is connected between said one end of the actuator and the lifting arm (or the mast) such that an auxiliary link incorporating a load cell can be additionally and removably connected between said one end of the actuator and the lifting arm (or the mast) and such that any load then applied to the lifting arm is transmitted entirely through the auxiliary link and not through the connecting link.

According to a second aspect of the present invention, there is provided an invalid hoist as claimed in any one of the preceding claims, in combination with an auxiliary link incorporating a load cell.

It is thus possible to supply one or a small number of auxiliary links, each incorporating a load cell, for use with a much larger number of hoists. The auxiliary link may then be used only when needed.

The invention will now be more particularly described, by way of example only, with reference to the accompanying drawings.

BRIEF DESCRIPTION OF THE DRAWINGS

FIG. 1 is a side view of a known invalid hoist,

FIG. 2 is a fragmentary side view showing the connection between the actuator and the lifting arm of the hoist of FIG. 1 on an enlarged scale, FIG. 3 is a fragmentary side view showing the connection between the actuator and the mast of the hoist of FIG. 1 in one condition, FIG. 4 is a fragmentary side view showing the connection between the actuator and the mast of the hoist of FIG. 1 in another condition, FIG. 5 is an enlarged perspective view of one embodiment of a connecting link of the invalid hoist shown in FIG. 1, FIG. 6 is a schematic side view of the connection between the lifting arm of the hoist of FIG. 1 and the connecting link of FIG. 5, shown in two conditions, FIG. 7 is a schematic side view of one embodiment of an auxiliary link, in accordance with the second aspect of the present invention, and FIG. 8 is a fragmentary perspective view of one end of the auxiliary link.

DESCRIPTION OF THE PREFERRED EMBODIMENTS

Referring now to FIGS. 1 to 4 of the drawings, the invalid hoist shown therein has a mobile chassis 10 provided with castors 11, a fixed length mast 12 upstanding from the chassis 10 and a lifting arm 13 pivotably connected intermediate its ends to the upper end of the mast 12 about a pivot shaft 14.

A sling hanger 15 is connected to one end of the lifting arm 13 and a motor driven extendible/retractable actuator 16 is connected between the other end of the lifting arm 13 and a bracket 17 secured to a lower end portion of the mast 12. The sling hanger has a plurality of sling attachment points (not shown) for supporting a full body sling in known manner (see, for example, GB2184706). The actuator 16 is powered by a rechargeable battery 8.

The length of the lifting arm 13 between the sling hanger 15 and the mast 12 is greater than the length of the lifting arm between the mast 12 and the actuator 16.

A connecting link 18 is connected between the upper end of the actuator 16 and a lug 19 fixed to said other end of the lifting arm 13. One end of the connecting link 18 is pivotably connected to the upper end of the actuator 16 and the other end of the connecting link 18 is pivotably connected to the lug 19. If the lifting arm 13 meets with an obstruction during a patient lowering operation, the connecting link 18 and actuator 16 will pivot relative to one another, as shown in FIG. 2, so that the actuator 16 can continue to extend without applying a force to the lifting arm to urge the latter against the obstruction.

As shown in FIGS. 3 and 4, the actuator 16 is pivotably connected to the bracket 17 by a pivot pin 20. The pivot pin 20 is fixed relative to the bracket 17 and extends through an elongate slot 21 formed in the lower end of the actuator 16. The actuator 16 is thus connected to the bracket 17 for limited upwards and downwards movement determined by the length of the slot 21 and the diameter of the pivot pin 20. A sensor, typically in the form of a microswitch 22, senses when the actuator 16 is in a lowermost position and de-energises the actuator 16.

The leverage applied by the lifting arm 13 (particularly when the sling hanger 15 supports a patient in a sling) will normally place the actuator 16 under tension and, in this condition, the actuator 16 will adopt its uppermost position relative to the bracket 17, as shown in FIG. 3. However, if the lifting arm 13 meets with an obstruction during a patient lowering operation, the actuator 16 will move to its lowermost position relative to the bracket 17, as shown in FIG. 4. The actuator 16 will trip the microswitch 22 and de-energise the actuator.

A handle 23 is connected to an upper part of a mast so that a helper can move the hoist along the ground.

Referring now to FIGS. 5 and 6, the connecting link 18 comprises two arms 23 each of which is permanently connected to the lifting arm 13 and the actuator 16 by respective pins 25 and 26.

Each arm 23 has an elongate slot 27 at or adjacent to each of its opposite ends. The slots 27 are dimensioned to receive respective pins 25 and 26 as a sliding fit. The ends of the pins 25 and 26 are typically stepped. This enables the arms 23 to be held in parallel spaced relationship.

The ends of the slots 27 closest to the ends of the arms 23 are spaced a distance 'X' (as shown in FIG. 6) from each other, for a reason which will become apparent hereinafter.

An auxiliary link 29 is shown in FIGS. 7 and 8. The auxiliary link 29 comprises a body 30 which includes a load cell 31 and which has hook-shaped formations 33 at each end of the body 30. The auxiliary link 29 may also be provided with a dedicated display (not shown) for displaying a load sensed by the load cell 31. The two hook-shaped formations 33 may be contra-orientated as shown in FIG. 7 to aid centralisation of a transmitted load.

As shown in FIG. 8, each hook-shaped formation 33 comprises two hook-shaped elements 33*a* and 33*b* which are laterally spaced apart to accommodate the lug 19 on the lifting arm and a similar lug at the upper end of the actuator 16.

The troughs 33*c* of the hook-shaped elements 33*a* and 33*b* are spaced a distance 'Y' from each other (as shown in FIG. 7). This distance 'Y' is less than the distance 'X' between the ends of the slots 27.

As such, since the effective length of the auxiliary link 29 is less than the maximum effective length of the connecting link 18, when the auxiliary link 29 is hooked over the two pins 25 and 26, respectively, the load applied by the lifting arm 13 and any patient supported therefrom, will be transmitted entirely through the auxiliary link 19 and not through the connecting link 18. The load detected by the load cell 31 will then be representative of the weight of the patient.

With such an arrangement, it is possible to supply a single auxiliary link 29, incorporating a load cell 31, for use with a plurality of invalid hoists. The auxiliary link 29 can be used as and when required. The arrangement is failsafe in that if a nurse or carer fails to install the auxiliary link properly, the load will be taken by the arms 23 and this will avoid the occurrence of accidents which could happen if the links 18 and 29 were to be interchangeable.

The invalid hoist described above is designed to lift a patient in a full body support sling. It could, however, be modified to serve as a standing aid for raising a patient from a seated to a standing position. In this case, the said one end of the lifting arm can be forked to provide two laterally spaced sling attachment points for attaching a sling which passes around the back of a patient and below the patient's armpits. In this case, the chassis may be provided with a footrest and a knee abutment may be provided on the mast.

The embodiment described above is given by way of example only and various modifications will be apparent to persons skilled in the art without departing from the scope of the invention as defined by the appended claims. For example, the motor driven actuator 16 could be replaced by a fluid pressure operated actuator. The arms 23 of the connecting link 18 could each have an elongate slot at one end only. Also, instead of being rigid, the connecting link 18 could be flexible.

What is claimed is:

1. An invalid hoist comprising a mobile chassis, a mast upstanding from the chassis, a lifting arm pivotably connected to an upper end of the mast, the lifting arm having a sling hanger or at least one sling attachment point at or adjacent to one end thereof, a power operated extendible/retractable actuator between the lifting arm and a lower part of the mast, the lifting arm being pivotably connected to the upper end of the mast at a position intermediate its ends and the actuator being connected to the lifting arm on the side of the pivotable connection between the lifting arm and the mast remote from said one end of the lifting arm, and a connecting link pivotably connected between one end of the actuator and one of the lifting arm and the mast so that if the lifting arm meets with an obstruction during a lowering operation, the actuator and link will pivot relative to one another so that the actuator can continue to extend without applying a force to the lifting arm to urge the latter against the obstruction, wherein the connecting link is connected between said one end of the actuator and one of the lifting arm and the mast such that an auxiliary link including a load cell can be additionally and removably connected between said one end of the actuator and one of the lifting arm and the mast, and such that any load then applied to the lifting arm is transmitted entirely through the auxiliary link and not through the connecting link.

2. The invalid hoist as claimed in claim 1, wherein the connecting link is connected to at least one of the actuator, the lifting arm and the mast by a pin on one part and an elongate slot on the other part.

3. The invalid hoist as claimed in claim 2, wherein the elongate slot is provided in the connecting link and the pin is provided on the at least one of the actuator, the lifting arm and mast.

4. The invalid hoist as claimed in claim 1, further comprising de-energizing means for de-energizing the actuator in response to a lack of tension applied to the actuator.

5. The invalid hoist as claimed in claim 4, wherein the actuator is connected to the mast for limited movement relative thereto between a first position which it occupies when under tension, and a second position which is lower than the first position and which it occupies when not under tension.

6. The invalid hoist as claimed in claim 5, wherein the de-energizing means comprise a microswitch operable to de-energize the actuator when the actuator moves to said second position.

7. The invalid hoist as claimed in claim 1, in combination with an auxiliary link including a load cell.

8. The combination as claimed in claim 7, wherein the auxiliary link is provided with a dedicated display for displaying a load sensed by the load cell.

9. The combination as claimed in claim 7, wherein the connecting link is connected between a pin on the actuator and a pin on one of the lifting arm and the mast and wherein the auxiliary link has a hook-shaped formation at opposite ends for hooking over the two pins, respectively.

* * * * *